US011327419B2

(12) United States Patent
Hori

(10) Patent No.: US 11,327,419 B2
(45) Date of Patent: May 10, 2022

(54) IMAGING SYSTEM INCLUDING LINK MECHANISM TO PIVOT STEERING MEMBER

(71) Applicant: Hewlett-Packard Development Company, L.P., Spring, TX (US)

(72) Inventor: Satoru Hori, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/413,006

(22) PCT Filed: Jan. 15, 2020

(86) PCT No.: PCT/US2020/013608
§ 371 (c)(1),
(2) Date: Jun. 11, 2021

(87) PCT Pub. No.: WO2020/154142
PCT Pub. Date: Jul. 30, 2020

(65) Prior Publication Data

US 2022/0019161 A1 Jan. 20, 2022

(30) Foreign Application Priority Data

Jan. 22, 2019 (JP) ..... JP2019-008745

(51) Int. Cl.
*G03G 15/01* (2006.01)
*G03G 15/16* (2006.01)

(52) U.S. Cl.
CPC ..... *G03G 15/1615* (2013.01)

(58) Field of Classification Search
CPC ..... G03G 15/1615
USPC ..... 399/302
See application file for complete search history.

(56) References Cited

U.S. PATENT DOCUMENTS

| | | | | |
|---|---|---|---|---|
| 8,095,053 | B2 | 1/2012 | Hara et al. | |
| 8,126,364 | B2 | 2/2012 | Masaki et al. | |
| 8,238,793 | B2 | 8/2012 | Nakura et al. | |
| 8,837,989 | B2 | 9/2014 | Yasumoto | |
| 2015/0277297 | A1 | 10/2015 | Fujisawa et al. | |
| 2021/0223720 | A1* | 7/2021 | Miyake et al. | G03G 15/1615 |
| 2021/0263449 | A1* | 8/2021 | Miyake | G03G 15/1615 |

FOREIGN PATENT DOCUMENTS

| | | | |
|---|---|---|---|
| JP | 5251309 | B2 | 7/2013 |
| JP | 5366783 | B2 | 12/2013 |
| JP | 5825873 | B2 | 12/2015 |
| KR | 10-0238325 | B1 | 1/2000 |

* cited by examiner

*Primary Examiner* — William J Royer
(74) *Attorney, Agent, or Firm* — Jefferson IP Law, LLP

(57) ABSTRACT

An imaging system includes a belt roller, an endless belt, a steering member, a tilting mechanism, and a link mechanism. The endless belt rotates about the belt roller which extends in a longitudinal direction. The steering member is located inside the endless belt. The tilting mechanism is operably coupled to a center portion of the steering member. The link mechanism is operably coupled to the tilting mechanism and operates the tilting mechanism so that the steering member is tilted in response to a displacement of the endless belt in the longitudinal direction of the belt roller.

15 Claims, 18 Drawing Sheets

IMAGING SYSTEM INCLUDING LINK MECHANISM TO PIVOT STEERING MEMBER

BACKGROUND

Some image forming systems include an endless belt as an intermediate transfer belt to transfer toner. The endless belt is stretched over a drive roller and a tension roller, and moves as the drive roller is rotationally driven. Some image forming systems include a steering roller located inside the endless belt. The steering roller is tilted when the endless belt is displaced in the longitudinal direction of the drive roller or the tension roller to correct the displacement of the endless belt.

DETAILED DESCRIPTION

In the following description, with reference to the drawings, the same reference numbers are assigned to the same components or to similar components having the same function, and overlapping description is omitted.

An example belt driving device of an imaging system is used as a transfer device which may secondarily transfer a toner image developed by a developing device in an image forming apparatus such as a printer. In some examples, an imaging system may include an imaging apparatus such as a printer. In some examples, an imaging system may include a developing device to be mounted in or to be operable with an imaging apparatus. The example belt driving device may include an endless belt, where the endless belt is an intermediate transfer belt of the transfer device. The belt driving device may be used in a printing medium conveying device which conveys a printing medium such as a sheet (e.g., paper sheet). In this case, the endless belt of the belt driving device functions as a printing medium conveying belt which conveys a printing medium.

Figure 1:
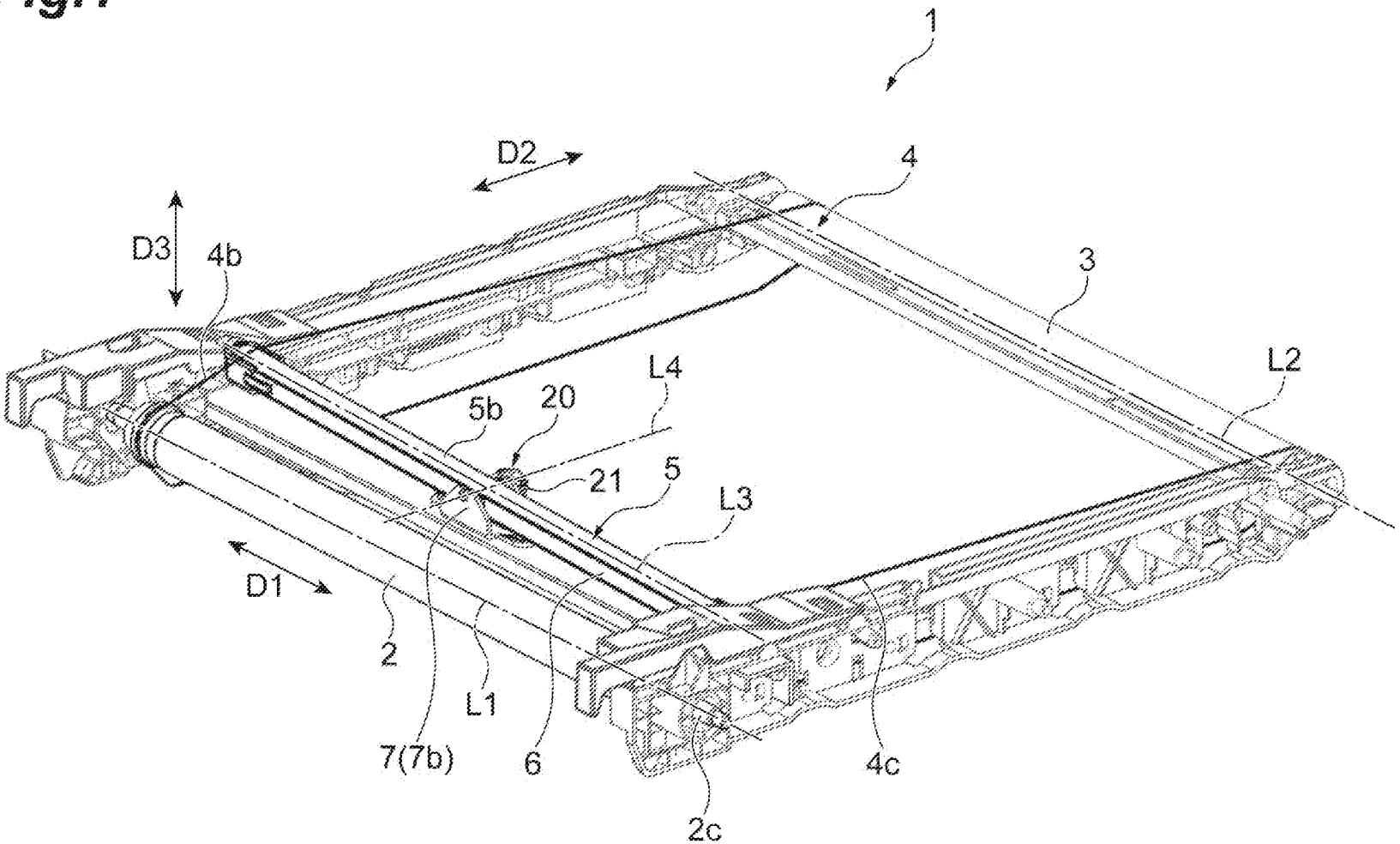
FIG. 1 is a perspective view of an example belt driving device of an example imaging system.

With reference to FIG. 1, an example belt driving device 1 includes a first belt roller 2, a second belt roller 3, and an endless belt 4 which is stretched over the first belt roller 2 and the second belt roller 3. In the drawings, an inner structure of the endless belt 4 is indicated by solid lines for easier understanding. Each of the first belt roller 2 and the second belt roller 3 may extend in a direction D1. The direction D1 indicates the longitudinal direction of each of the first belt roller 2 and the second belt roller 3 and the width direction of the endless belt 4. The first belt roller 2 and the second belt roller 3 may face each other in a direction D2 intersecting the direction D1.

The first belt roller 2 may include a drive roller which drives the endless belt 4. The second belt roller 3 is a driven roller which follows the driving of the first belt roller 2. The first belt roller 2 may receive power from an electric motor. In this case, the first belt roller 2 rotates about an axis L1 extending in the direction D1 by the power from the electric motor. The first belt roller 2 may include a columnar shaft portion 2*c* which includes the axis L1. In some examples, the endless belt 4 is stretched over the first belt roller 2 and the second belt roller 3 and moves in a circulating manner along the outer circumference of the first belt roller 2 and the outer circumference of the second belt roller 3 in the direction D2 as the first belt roller 2 rotates. The second belt roller 3 rotates about an axis L2 as the endless belt 4 moves.

In some examples, the belt driving device 1 includes a steering member 5 that corrects the displacement of the endless belt 4 in the direction D1. When the steering member 5 contacts the endless belt 4, the displacement of the endless belt 4 is corrected. The example steering member 5 is a steering roller which extends in the direction D1 along with the first belt roller 2 and the second belt roller 3. In some examples, the steering member 5 is a steering roller which is located between the first belt roller 2 and the second belt roller 3 and extends in the direction D1 inside the endless belt 4.

Figure 2:
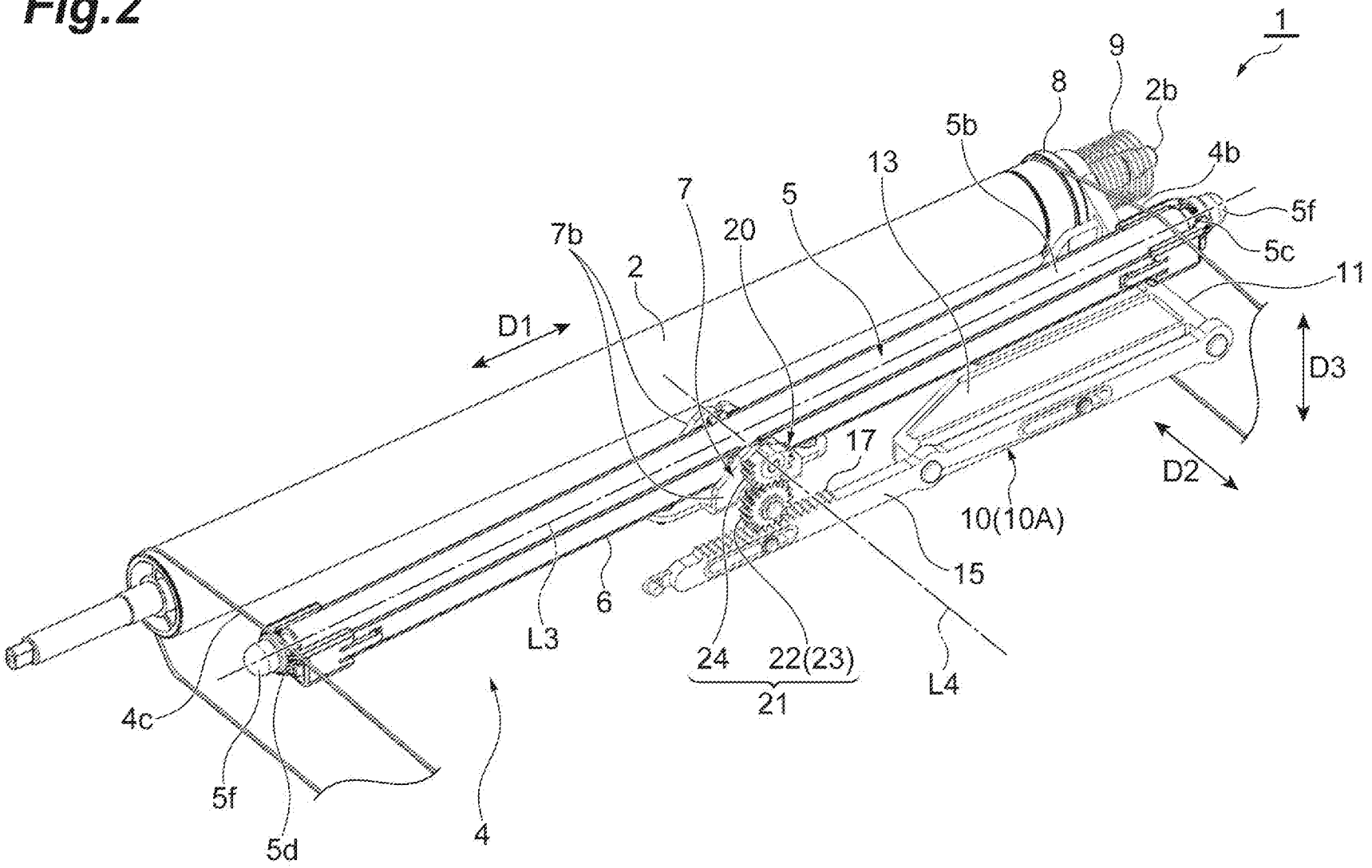
FIG. 2 is a perspective view of components of the example belt driving device illustrated in FIG. 1, including a first belt roller, a steering member, a tilting mechanism, and a link mechanism.

With reference to FIGS. 1 and 2, the example belt driving device 1 may include a tilting mechanism 20 which is operably connected to a center portion of the steering member 5, and a link mechanism 10 which is operably connected or coupled to the tilting mechanism 20. In the present description, the "center portion of the steering member" indicates a portion including the center of the steering member 5 in the longitudinal direction and includes the intermediate point of the steering member 5 in the longitudinal direction and also the position of the steering member 5 slightly displaced from the intermediate point. For example, a position or regions slightly spaced from the intermediate point of the steering member 5 in the direction D1 is also included in the center portion of the steering member 5. In some examples, the endless belt 4 includes a first edge portion 4*b* (also referred to herein as first end portion 4*b*) which is located at one end in the direction D1, and a second edge portion 4*c* (also referred to herein as second end portion 4*c*) which is located at the other end in the direction D1. The steering member 5 may be disposed at the upstream side of the first belt roller 2 and the downstream side of the second belt roller 3 in the circumferential movement direction of the endless belt 4. The steering member 5 may be disposed above the circumferential path (e.g., circumferential orbit) of the endless belt 4 so as to contact the inner circumferential surface of the endless belt 4 directed from the second belt roller 3 toward the first belt roller 2. In some examples, the steering member 5 is disposed at a position near the first belt roller 2 in relation to the intermediate point of the first belt roller 2 and the second belt roller 3.

In some examples, an outer circumferential surface 5*b* of the steering member 5 contacts the inner circumferential surface of the endless belt 4. In some examples, the steering member 5 rotates about an axis L3 in a driven manner as the endless belt 4 moves in a circulating manner. A first end 5*c* and a second end 5*d* respectively provided at both ends of the steering member 5 may be protected by a cap 5*f*. In some examples, the outer circumferential surface of the cap 5*f* is formed in a spherical shape. Each of the first end 5*c* and the second end 5*d* may be movable in a direction D3 intersecting both of the direction D1 and the direction D2.

The belt driving device 1 may include a support member 6 that extends in the direction D1, and a rotation shaft portion 7 which is provided at the center of the support member 6 in the direction D1 to be connected to the support member 6. In some examples, the support member 6 extends in the longitudinal direction of the steering member 5. The support member 6 may be disposed to cover the lower portion of the outer circumferential surface 5*b* of the steering member 5. The rotation shaft portion 7 may support the support member 6 in a pivotable (e.g., swingable) manner. The rotation shaft portion 7 may include a pair of clamping portions 7*b* which clamps the support member 6 from both sides of the direction D2. Each of the pair of clamping portions 7*b* is connected to the support member 6 below the support member 6.

In some examples, the steering member 5 may be pivotable (or swingable) about an axis L4 which passes through the rotation shaft portion 7 and extends in the direction D2. In this case, each of the first end 5*c* and the second end 5*d* of the steering member 5 pivots along the direction D3 as the steering member 5 pivots about the axis L4. In some examples, the steering member 5 is tiltable by using the pair of clamping portions 7*b* as a fulcrum when one of the first end 5*c* and the second end 5*d* is pressed.

In some examples, the link mechanism 10 may move along the direction D1. The link mechanism 10 may include a slide member 10A that moves in the direction D1 in response to the displacement of the endless belt 4 in the direction D1, and that tilts the steering member 5 when the link mechanism 10 moves in the direction D1. The slide member 10A may extend from one end 2*b* of the first belt roller 2 in the direction D1 toward the steering member 5. The example slide member 10A may include a first member 11 that is attached to one end 2*b* of the first belt roller 2 and a second member 15 that is connected to the tilting mechanism 20.

In some examples, the tilting mechanism 20 may be provided inside the endless belt 4, coupled (e.g., connected) to the clamping portion 7*b* of the rotation shaft portion 7. In some examples, the tilting mechanism 20 tilts the steering member 5 through the clamping portion 7*b*. The example tilting mechanism 20 may include a gear portion 21 which is fixed to the steering member 5 and coupled (or connected) to the link mechanism 10. The steering member 5 may be tilted by the rotation of the gear portion 21.

Figure 3:
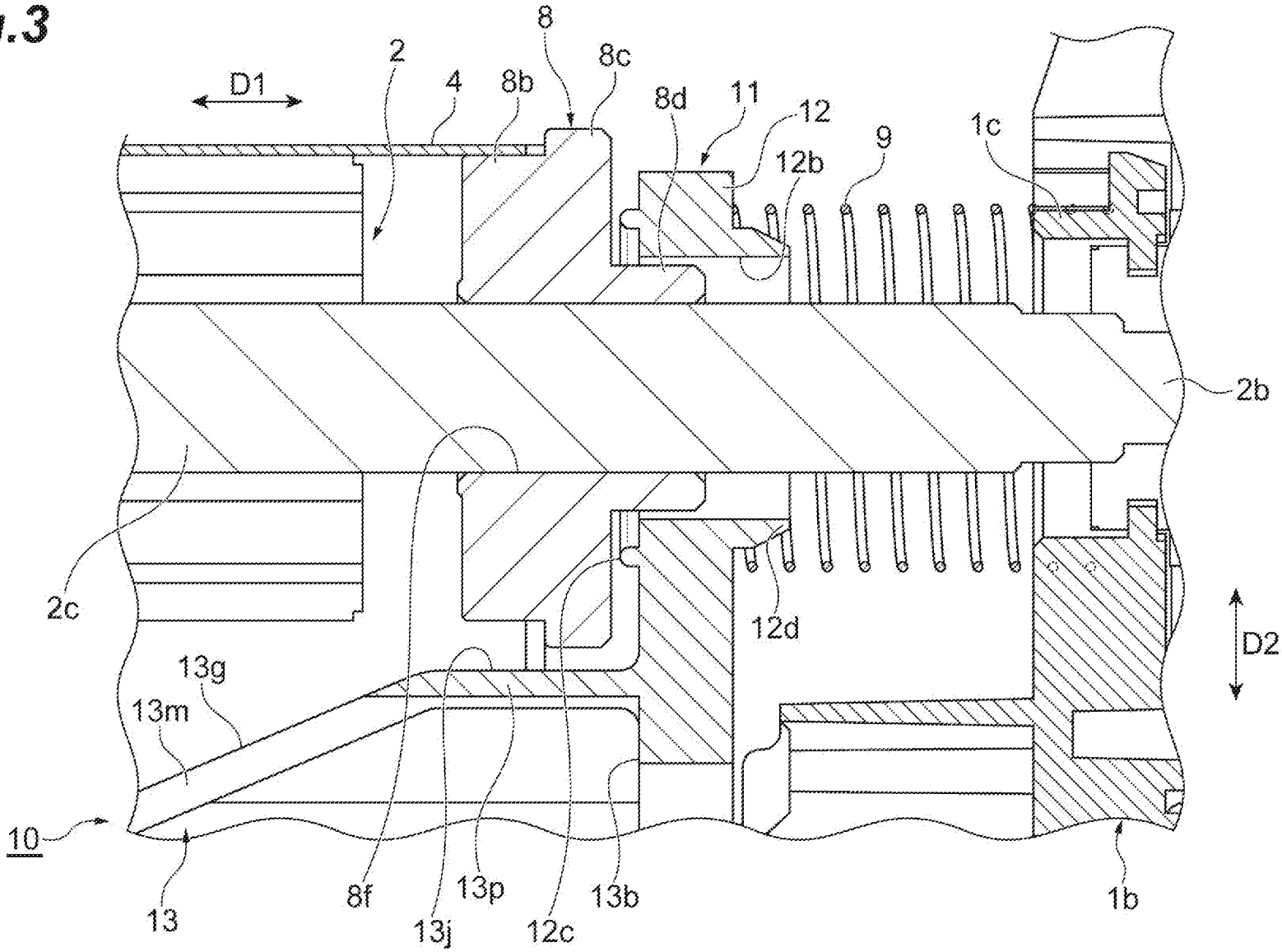
FIG. 3 is a cross-sectional view of a structure in the periphery of an end of the first belt roller illustrated in FIG. 2.
Figure 4:
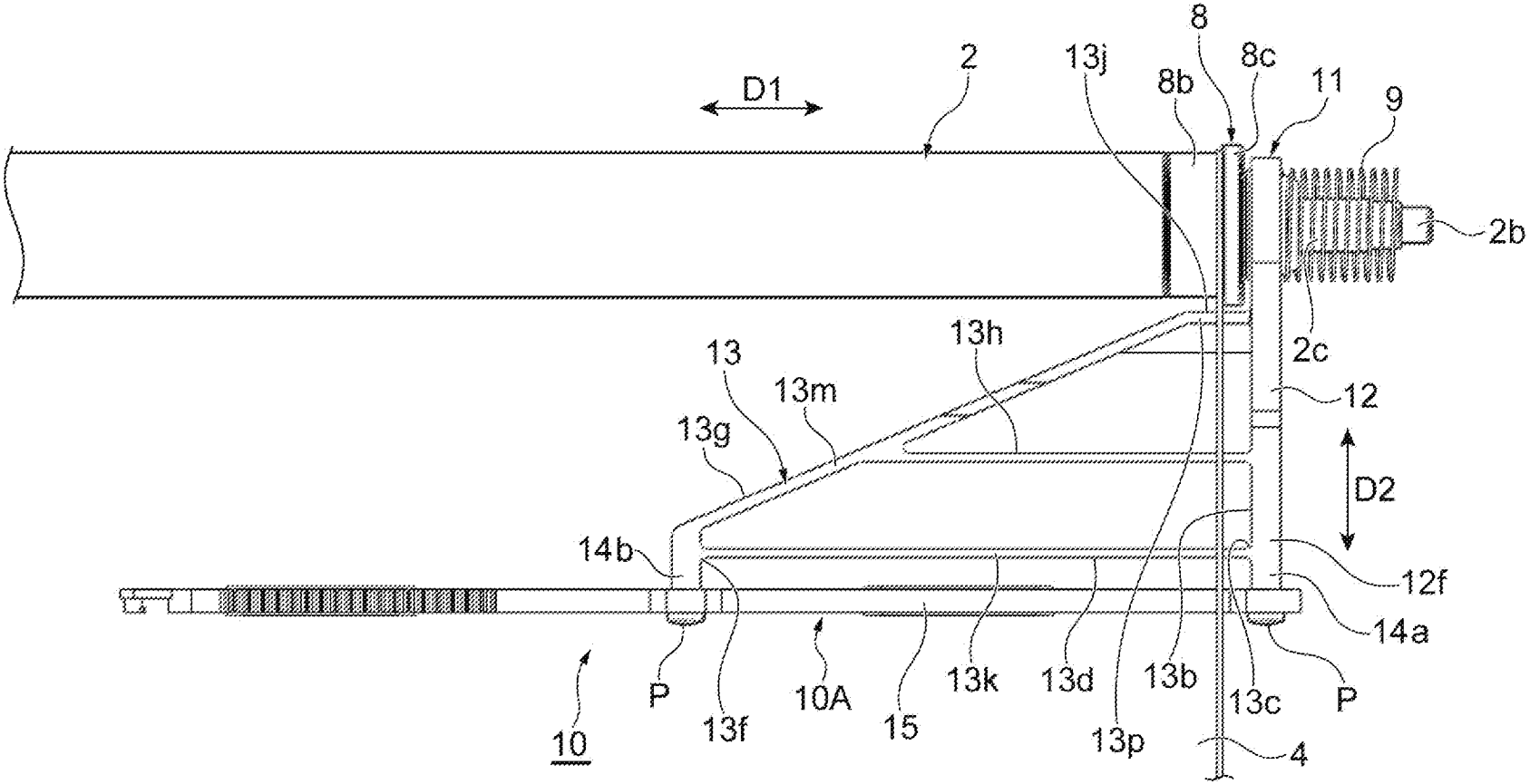
FIG. 4 is a partial plan view of the first belt roller and the link mechanism illustrated in FIG. 2.

FIG. 3 is a cross-sectional view illustrating an example structure in the periphery of the one end 2*b* of the first belt roller 2. FIG. 4 is a plan view illustrating the one end 2*b* of the first belt roller 2 and the slide member 10A. With reference to FIGS. 3 and 4, the end 2*b* of the first belt roller 2 includes a pulley 8, a spring 9, and a first member 11. In some examples, the pulley 8 includes a tubular portion 8*b* covered by the endless belt 4, a flange portion 8*c* which is enlarged at an end portion of the tubular portion 8*b* in the direction D1, and a small diameter portion 8*d* which is provided at the side opposite to the tubular portion 8*b* of the flange portion 8*c*. In some examples, the pulley 8 includes a through-hole 8*f* which penetrates the tubular portion 8*b*, the flange portion 8*c*, and the small diameter portion 8*d* in the direction D1. The shaft portion 2*c* of the first belt roller 2 is inserted through the through-hole 8*f*.

The first member 11 may include a first plate-shaped portion 12 and a second plate-shaped portion 13. The first plate-shaped portion 12 has a constant thickness in the direction D1 and extends in the direction D2 from an end portion of the first belt roller 2 in the direction D1 when viewed from the pulley 8. The second plate-shaped portion 13 extends from the first plate-shaped portion 12 along the first belt roller 2. The first plate-shaped portion 12 may include a through-hole 12*b* which penetrates in the direction D1. The small diameter portion 8*d* of the pulley 8 and the shaft portion 2*c* of the first belt roller 2 are inserted into the through-hole 12*b* in the direction D1.

In some examples, the first plate-shaped portion 12 includes an annular protrusion 12*c* which surrounds the through-hole 12*b* and protrudes toward the pulley 8. The annular protrusion 12*c* faces the flange portion 8*c* of the pulley 8. The first plate-shaped portion 12 may include a tubular portion 12*d* which surrounds the through-hole 12*b* and protrudes toward the side opposite to the annular protrusion 12*c*. The spring 9 is wound on the tubular portion 12*d*. In the link mechanism 10 a portion other than the first plate-shaped portion 12 may be provided inside the endless belt 4.

In some examples, the spring 9 urges the pulley 8 and the first member 11 of the link mechanism 10 toward the center side of the direction D1 (the left side in FIGS. 3 and 4). In some examples, an end of the spring 9 is wound on the tubular portion 12*d* of the first plate-shaped portion 12 and the other end of the spring 9 is wound on a tubular portion 1*c* formed in a frame 1*b* of the belt driving device 1. The first member 11 may extend from the spring 9 and the pulley 8 toward the steering member 5 in the direction D2.

In some examples, the second plate-shaped portion 13 is provided inside the endless belt 4. In some examples, the second plate-shaped portion 13 includes a first side 13*b*, a second side 13*d* and a third side 13*g*. The first side 13*b* extends in the direction D2 intersecting the direction D1. The second side 13*d* extends from an end portion 13*c* at the side opposite to the first belt roller 2 of the first side 13*b* toward the tilting mechanism 20. The third side 13*g* extends from an end portion 13*f* at the side of the tilting mechanism 20 of the second side 13*d* toward the one end 2*b* of the first belt roller 2. In some examples, the first side 13*b*, the second side 13*d*, and the third side 13*g* form a right triangle. The second plate-shaped portion 13 may include a fourth side 13*j* extending from the third side 13*g* in the direction D1. For example, the fourth side 13*j* may be located at an end portion at the side of the one end 2*b* of the third side 13*g* to extend from the third side 13*g* in the direction D1.

In some examples, the second plate-shaped portion 13 includes a first rib 13*h* which extends in the direction D1, a second rib 13*k* which extends along the second side 13*d*, a third rib 13*m* which extends along the third side 13*g*, and a fourth rib 13*p* which extends along the fourth side 13*j*. In some examples, all of the first rib 13*h*, the second rib 13*k*, the fourth side 13*j*, and the fourth rib 13*p* protrude in an out-of-plane direction of the second plate-shaped portion 13 (for example, a direction orthogonal to the drawing sheets of FIGS. 3 and 4). A plurality of ribs increases a strength of the second plate-shaped portion 13.

In some examples, the first member 11 includes first and second connection portions 14*a* and 14*b* at an end portion opposite to the first belt roller 2, connected to the second member 15. In some examples, a first connection portion 14*a* is located at an end portion 12*f* at the side opposite to the first belt roller 2 of the first plate-shaped portion 12, and a second connection portion 14*b* is located at the end portion 13*f* at the side of the tilting mechanism 20 of the second plate-shaped portion 13. In some examples, the connection portions 14*a* and 14*b* protrude in the direction D2, respectively, from the first plate-shaped portion 12 and from the second plate-shaped portion 13. The protruding ends of the connection portions 14*a* and 14*b* are connected to the second member 15 by a pin P. In some examples, a single end of the second member 15 in the direction D1 (e.g., the right end in FIG. 4) is exposed from the endless belt 4. A portion other than the single end of the second member 15 is provided inside the endless belt 4.

Figure 5:
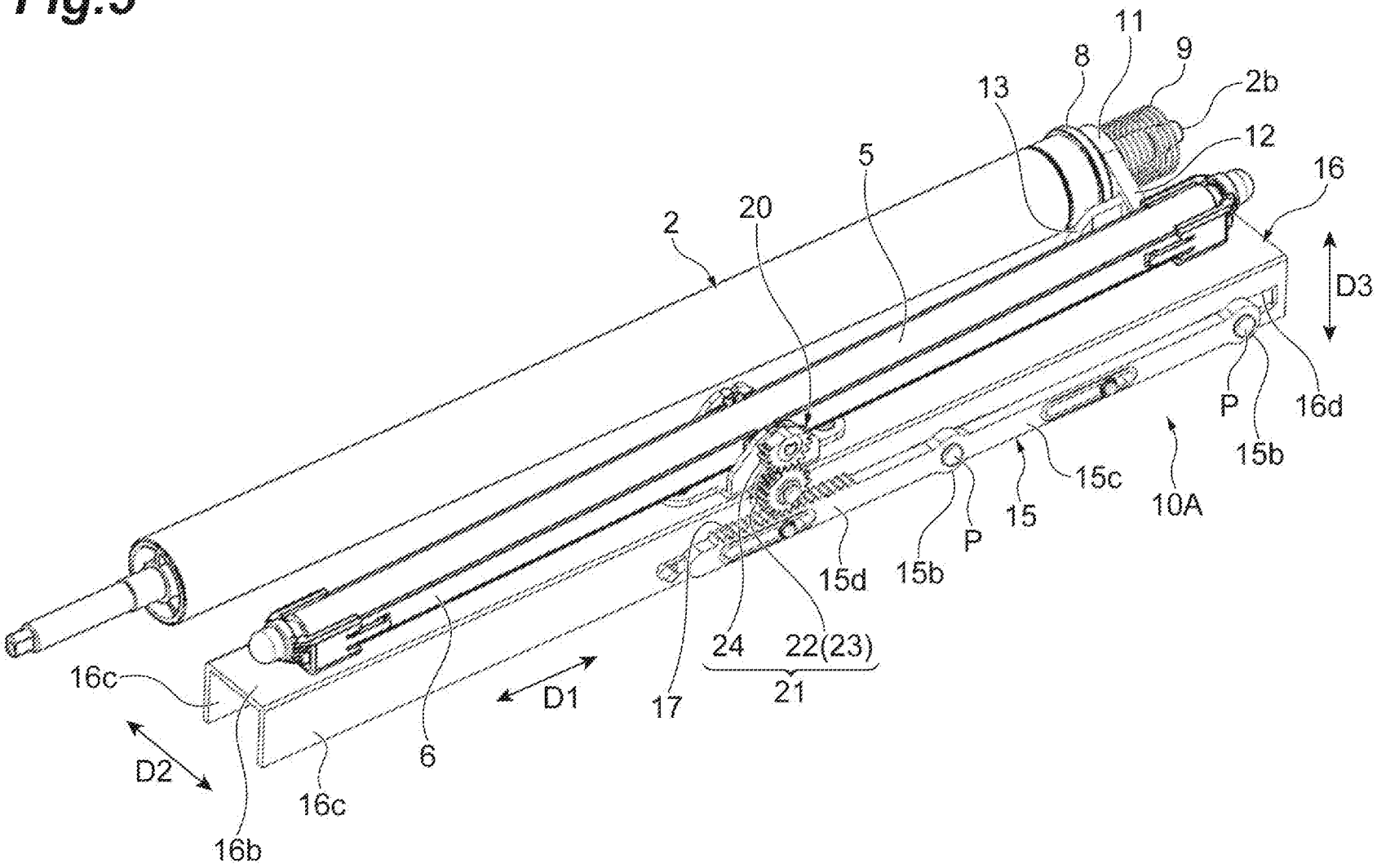
FIG. 5 is a perspective view of the components illustrated in FIG. 2.
Figure 6:
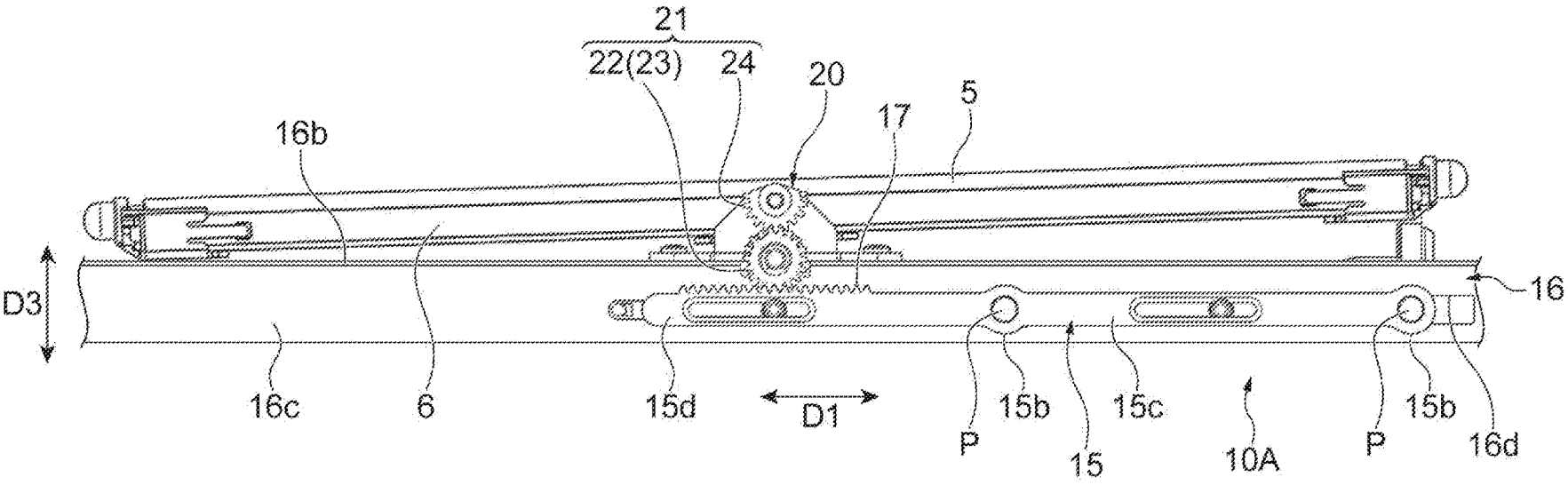
FIG. 6 is a side view of the components illustrated in FIG. 2.

With reference to FIGS. 5 and 6, the slide member 10A may include a guide member 16 that guides the sliding movement of the slide member 10A in the direction D1. In some examples, the guide member 16 covers a part of the first plate-shaped portion 12 and the second plate-shaped portion 13. The guide member 16 may extend in the direction D1 below the steering member 5 and the support member 6. In some examples, the guide member 16 includes a first plate portion 16*b* which has a rectangular shape with a long side extending in the direction D1 and a short side extending in the direction D2, and a pair of second plate portions 16*c* which is bent downward from the end portion of the first plate portion 16*b* in the width direction. The pair of second plate portions 16*c* may be arranged side by side in the direction D2.

One of the pair of second plate portions 16*c* may be provided with a through-hole 16*d* which extends in the direction D1 and penetrates in the direction D2. The pin P may be inserted through the through-hole 16*d*. Accordingly, the second member 15 is guided by the guide member 16 and linearly moves in the direction D1. The second member 15 may have a bar shape extending in the direction D1.

The example second member 15 includes a pair of insertion portions 15*b* through which the pin P is inserted, a first bar-shaped portion 15*c* which is located between the pair of insertion portions 15*b*, and a second bar-shaped portion 15*d* which is located at the side of the tilting mechanism 20 of the pair of insertion portions 15*b*. In some examples, the second member 15 linearly extends in the direction D1. The width of each insertion portion 15*b* in the direction D3 may be wider than the width of the first bar-shaped portion 15*c* in the direction D3 and the width of the second bar-shaped portion 15*d* in the direction D3.

In some examples, the slide member 10A includes a rack portion 17 which extends in the direction D1. The rack portion 17 is formed on the surface of the second bar-shaped portion 15*d* of the second member 15. The rack portion 17 includes a plurality of tooth portions which engage with the gear portion 21 of the tilting mechanism 20. The gear portion 21 rotates as the rack portion 17 moves linearly in the direction D1 and the steering member 5 is tilted as the gear portion 21 rotates.

Figure 7:
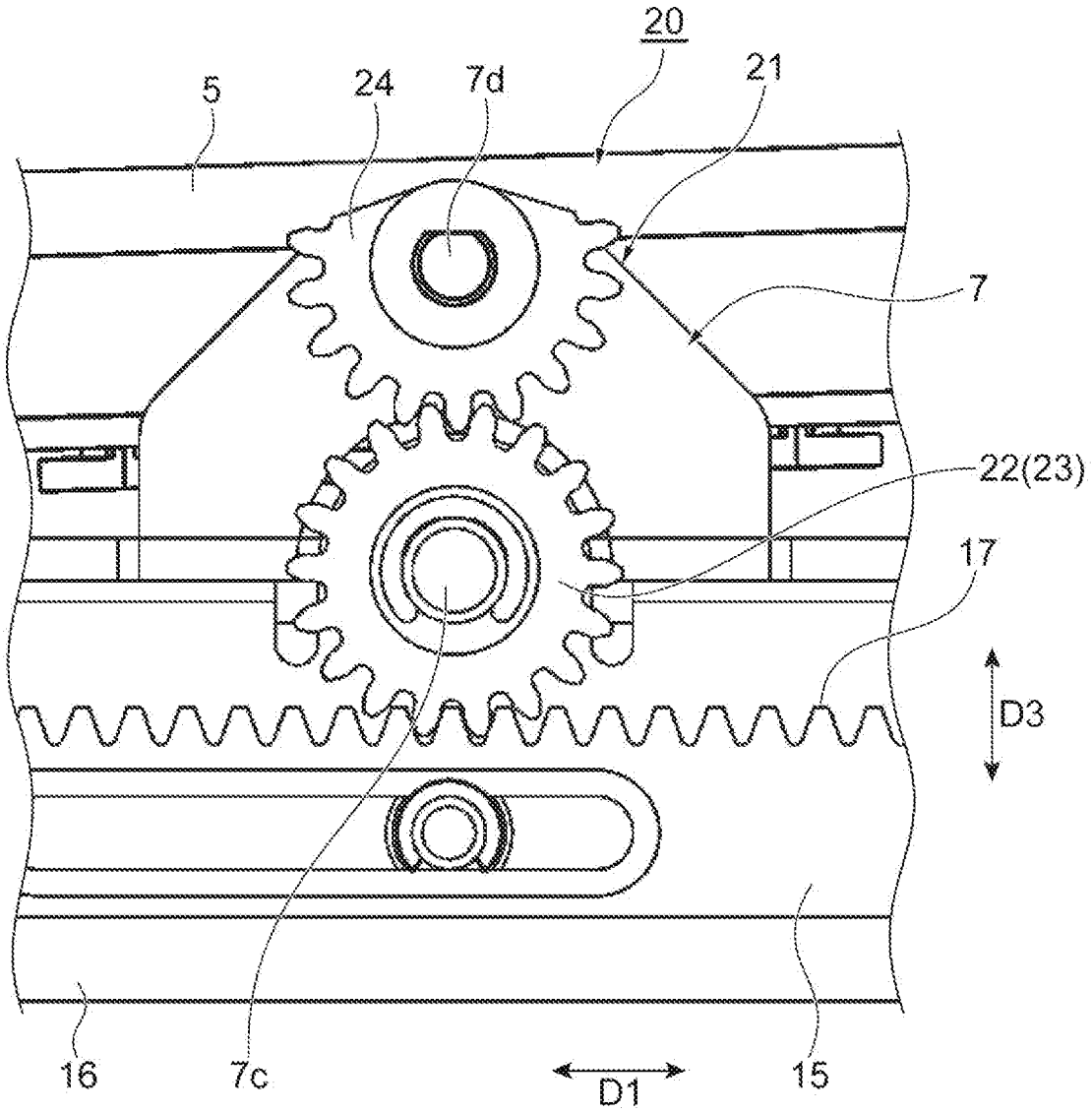
FIG. 7 is a partial side view of the tilting mechanism illustrated in FIG. 2.

FIG. 7 is an enlarged side view of the gear portion 21 of the example tilting mechanism 20. The gear portion 21 includes a pinion portion 22 which is connected to the rotation shaft portion 7 located at the center portion of the steering member 5 and engages with the rack portion 17. In some examples, the rack portion 17 of the link mechanism 10 and the pinion portion 22 of the tilting mechanism 20 constitute a rack and pinion mechanism. The gear portion 21 may include a first gear 23 which is the pinion portion 22 and a second gear 24 which is rotatable and connected to the center portion of the steering member 5 to tilt the steering member 5 in accordance with the rotation.

In some examples, the first gear 23 and the second gear 24 are arranged side by side in the direction D3 and the first gear 23 is disposed at the lower side in relation to the second gear 24. That is, the first gear 23 is disposed between the second gear 24 and the rack portion 17. In some examples, the first gear 23 is rotatably supported by a first shaft portion 7*c* protruding from the rotation shaft portion 7 in the direction D2 and the second gear 24 is rotatably supported by a second shaft portion 7*d* protruding from the rotation shaft portion 7 in the direction D2. In some examples, the first gear 23 includes a teeth portion formed on the entire circumference thereof and the second gear 24 includes a teeth portion formed at the lower portion thereof.

Figure 8:
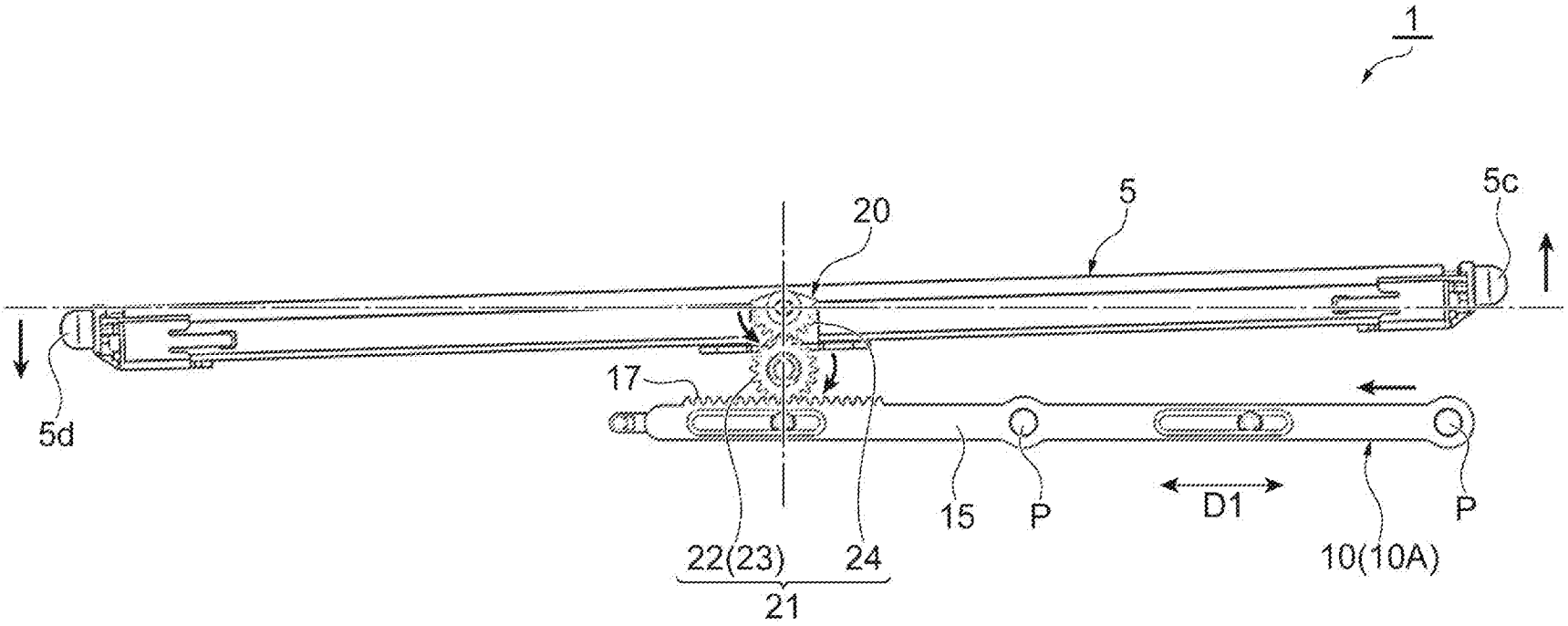
FIG. 8 is a side view illustrating an example state in which the steering member is tilted by the tilting mechanism and the link mechanism illustrated in FIG. 2.
Figure 9:
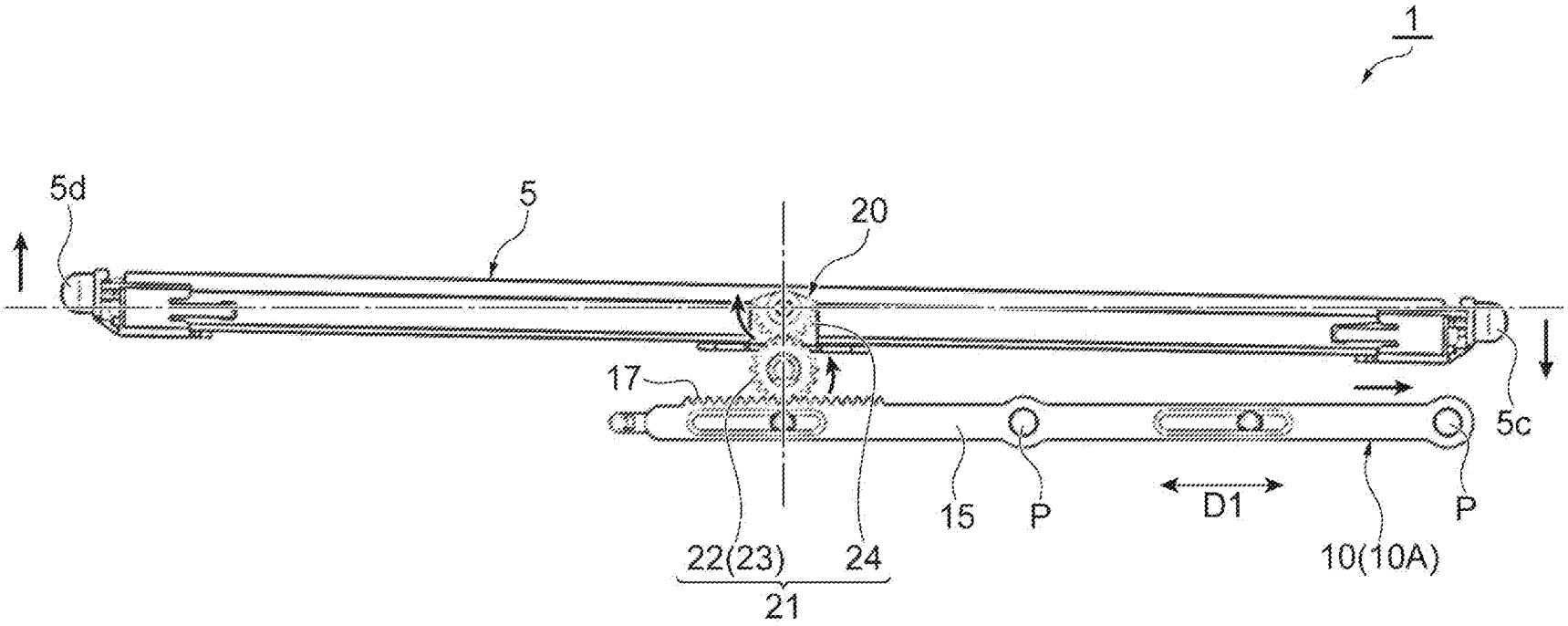
FIG. 9 is a side view illustrating another example state in which the steering member is tilted by the tilting mechanism and the link mechanism illustrated in FIG. 2.

Example operations of the example link mechanism 10 and the example tilting mechanism 20 will be described with reference to FIGS. 8 and 9. FIG. 8 is a side view illustrating an example in which the steering member 5 is tilted so that the first end 5*c* moves upward and the second end 5*d* moves downward. FIG. 9 is a side view illustrating an example in which the steering member 5 is tilted so that the first end 5*c* moves downward and the second end 5*d* moves upward.

With reference to FIG. 9, when the endless belt 4 is displaced toward the link mechanism 10 and the link mechanism 10 may move toward both ends of the direction D1 (e.g., the right side in FIG. 9) against the urging force of the spring 9, the rack portion 17 may move toward both ends in the direction D1 and the pinion portion 22 (e.g., the first gear 23) may rotate in a first direction (e.g., a counter-clockwise rotation direction in FIG. 9). When the pinion portion 22 rotates in one direction, the second gear 24 may rotate in a second direction (e.g., a clockwise rotation direction in FIG. 9) opposite to the first direction and the steering member 5 is tilted so that the second end 5*d* moves upward and the first end 5*c* moves downward.

With reference to FIG. 8, when the link mechanism 10 returns from both ends of the direction D1 by the urging force of the spring 9, the rack portion 17 may move toward the center side of the direction D1 (e.g., the left side in FIG. 8) and the pinion portion 22 (e.g., the first gear 23) may rotate in the above-described opposite direction (e.g., a clockwise rotation direction in FIG. 8). Then, when the pinion portion 22 rotates in the opposite direction, the second gear 24 may rotate in the above-described first direction (e.g., a counter-clockwise rotation direction in FIG. 8) and the steering member 5 may be tilted so that the second end 5*d* moves downward and the first end 5*c* moves upward.

With reference to FIG. 9, in the example imaging system including the belt driving device 1, when the first edge portion 4*b* of the endless belt 4 moves toward the first end 5*c*, the link mechanism 10 moves toward the end portion of the direction D1 and the steering member 5 is tilted so that the tilting mechanism 20 raises the second end 5*d*. When the second end 5*d* moves upward with respect to the first end 5*c*, a tension of the endless belt 4 with respect to the second end 5*d* becomes higher than a tension of the endless belt 4 with respect to the first end 5*c*. Accordingly, the endless belt 4 moves toward the second end 5*d*.

Since the endless belt 4 which is displaced toward the first end 5*c* of the steering member 5 moves toward the second end 5*d* by the link mechanism 10, the tilting mechanism 20, and the steering member 5, the displacement of the endless belt 4 toward the first end 5*c* is corrected. Accordingly, the steering member 5, the link mechanism 10, and the tilting mechanism 20 function as a belt position correction member that corrects the displacement of the endless belt 4.

With reference to FIG. 2, in the example belt driving device 1, the steering member 5 is located inside the endless belt 4, and the tilting mechanism 20 is operably connected to the center portion of the steering member 5. The tilting mechanism 20 is located inside the endless belt 4, to prevent foreign substances such as toner or paper dust from intruding into the tilting mechanism 20. Accordingly, an increase in sliding load of the tilting mechanism 20 due to the intrusion of foreign substances is inhibited, and the life span of the tilting mechanism 20 may be increased.

The link mechanism 10 may include the slide member 10A that tilts the steering member 5 when the link mechanism 10 moves in the direction D1 and moves in the longitudinal direction of the first belt roller 2 in response to the movement (displacement) of the endless belt 4. Accordingly, since the steering member 5 can be tilted by the sliding movement of the slide member 10A, a configuration of the link mechanism 10 which is connected to the tilting mechanism 20 tilting the steering member 5 can be simplified.

The tilting mechanism 20 may include the gear portion 21 which is fixed to the steering member 5 and connected to the link mechanism 10 and may convert a linear motion of the slide member 10A in the direction D1 into a rotational motion of the gear portion 21. Accordingly, the configurations of the link mechanism 10 and the tilting mechanism 20 tilting the steering member 5 can be simplified.

The slide member 10A may include the rack portion 17 extending in the direction D1, the gear portion 21 may include the pinion portion 22 connected to the rotation shaft portion 7 at the center portion of the steering member 5, and may engage with the rack portion 17. The tilting mechanism 20 may tilt the steering member 5 in accordance with the rotation of the pinion portion 22. Accordingly, since the steering member 5 can be tilted by the rack and pinion mechanism, a smoother tilting of the steering member 5 may be achieved with a simpler configuration.

The gear portion 21 may be located inside the endless belt 4, to prevent foreign substances such as toner or paper dust from intruding into the gear portion 21, in order to prevent an increase in rotation load of the gear portion 21. Accordingly, since it is possible to more smoothly tilt the steering member 5 for a long time, it is possible to further increase the life span of the tilting mechanism 20 and the endless belt 4.

The gear portion 21 may include the first gear 23 which is the pinion portion 22, and the second gear 24 which is rotatable and connected to the center portion of the steering member 5, to tilt the steering member 5 in accordance with the rotation. Since the gear portion 21 can be provided as two gears, the configuration of the tilting mechanism 20 can be simplified.

Figure 10:
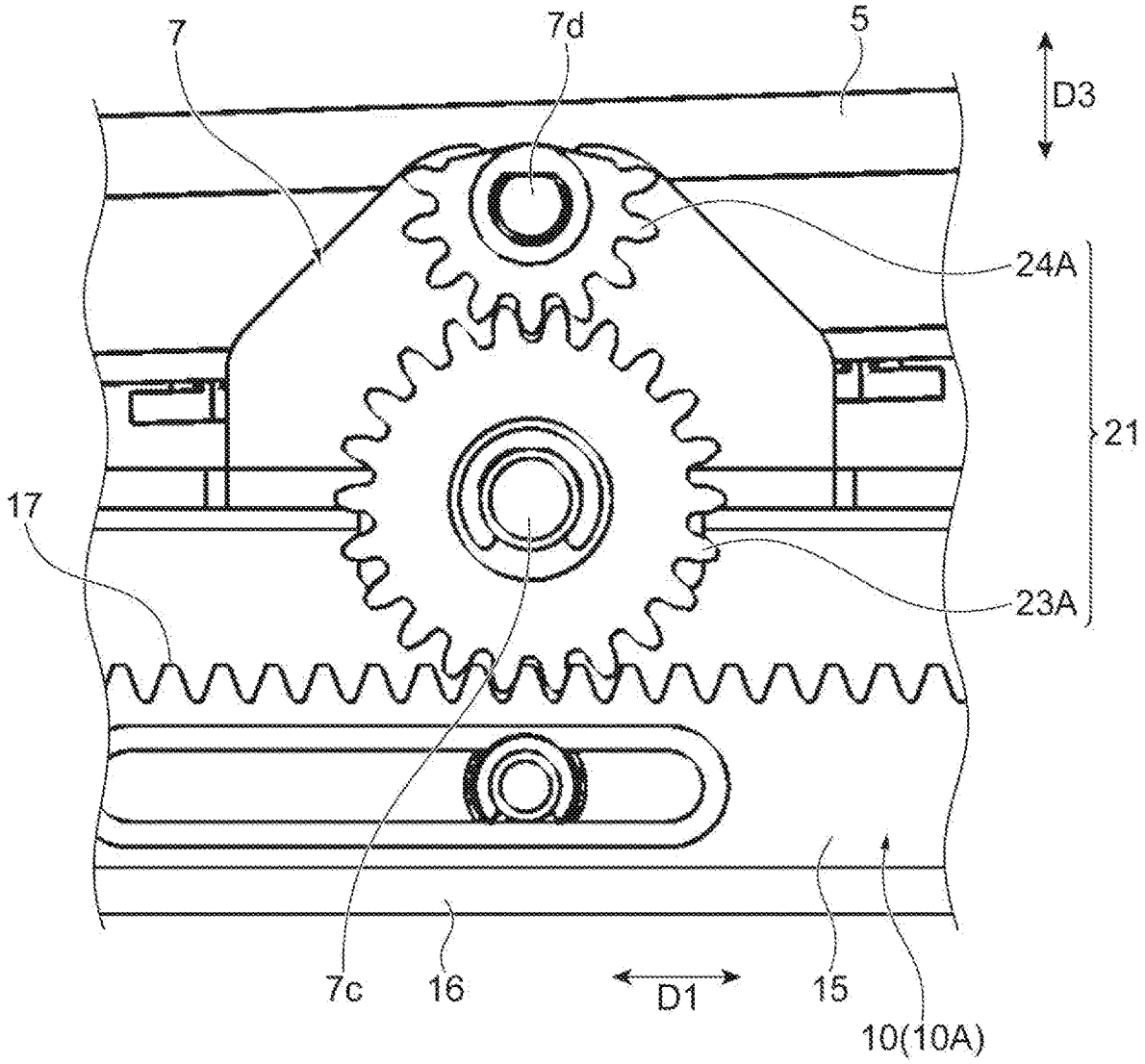
FIG. 10 is a side view illustrating an example gear portion of the tilting mechanism illustrated in FIG. 2.
Figure 11:
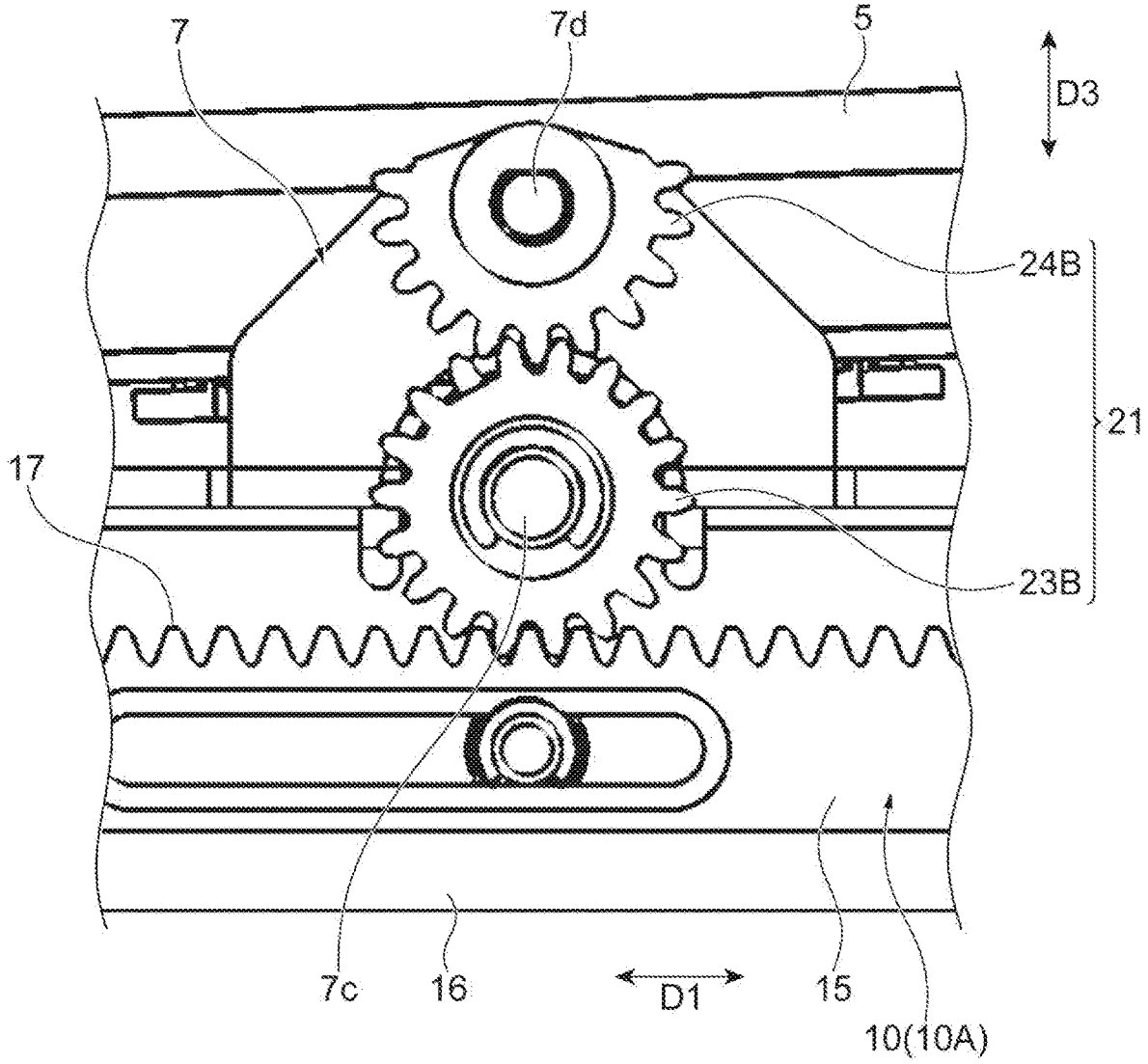
FIG. 11 is a side view illustrating another example gear portion.
Figure 12:
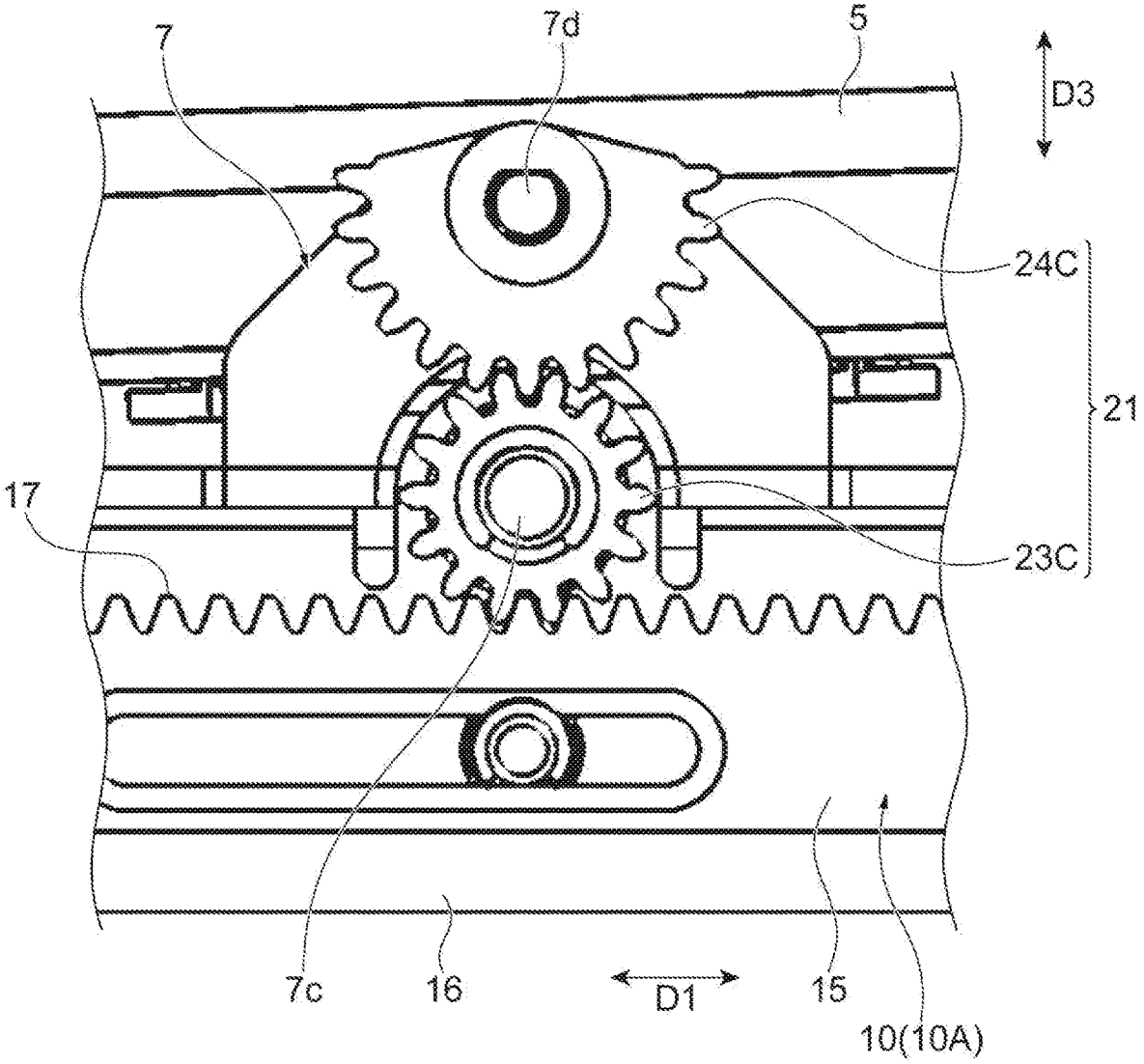
FIG. 12 is a side view illustrating another example gear portion.

With reference to FIGS. 10 to 12, in the example tilting mechanism 20, a gear constituting the gear portion 21 can be changed. FIG. 10 illustrates an example in which the diameter of a first gear 23A is larger than the diameter of a second gear 24A, FIG. 11 illustrates an example in which the diameter of a first gear 23B is the same as the diameter of a second gear 24B, and FIG. 12 illustrates an example in which the diameter of a first gear 23C is shorter than the diameter of a second gear 24C.

With reference to FIGS. 10 to 12, when the diameter of the first gear 23A is larger than the diameter of the second gear 24A, the rotation amount of the second gear 24A with respect to the movement amount of the rack portion 17 and the rotation amount of the first gear 23A increases. Accordingly, a relatively small movement of the link mechanism 10 may actuate the second gear 24 to rotate in a relatively large increment, in order to tilt the steering member 5 more promptly.

Meanwhile, when the diameter of the first gear 23C is smaller than the diameter of the second gear 24C, the rotation of the second gear 24C with respect to the movement amount of the rack portion 17 and the rotation amount of the first gear 23C decreases. Accordingly, the rotational motion of the second gear 24 and the tilting motion of the steering member 5 can be decreased even when the link mechanism 10 is moved in a relatively large increment. Accordingly, the tilting motion of the steering member 5 can be adjusted more finely. As described above, when the gear constituting the gear portion 21 can be changed, the tilting motion of the steering member 5 with respect to the movement amount of the link mechanism 10 can be better adjusted.

With reference to FIGS. 2 and 4, the slide member 10A may include the first member 11 that is attached to one end 2*b* of the first belt roller 2, and the second member 15 that is connected to the tilting mechanism 20. When the slide member 10A is formed as two components, the slide member 10A may be more easily assembled by connecting the two components.

The first member 11 may extend from one end 2*b* of the first belt roller 2 in the direction D2 intersecting the direction D1 and the second member 15 may extend from the first member 11 in the direction D1, in order to simplify the shapes of the first member 11 and the second member 15.

The first member 11 may include the first side 13*b* which extends in the direction D2, the second side 13*d* which extends from the end portion 13*c* at the side opposite to the first belt roller 2 of the first side 13*b* toward the tilting mechanism 20, and the third side 13*g* which extends from the end portion 13*f* at the side of the tilting mechanism 20 of the second side 13*d* toward one end 2*b* of the first belt roller 2. Accordingly, the shape of the first member 11 can be further simplified. The first side 13*b*, the second side 13*d*, and the third side 13*g* may be shaped in a right triangle, to further simplify the shape of the first member 11.

The belt driving device 1 may include the spring 9 which urges one end 2*b* of the first belt roller 2 through the slide member 10A, in order to return the tilting motion of the steering member 5 by the tilting mechanism 20 to an original state, and to better stabilize the tilting motion of the steering member 5.

Figure 13:
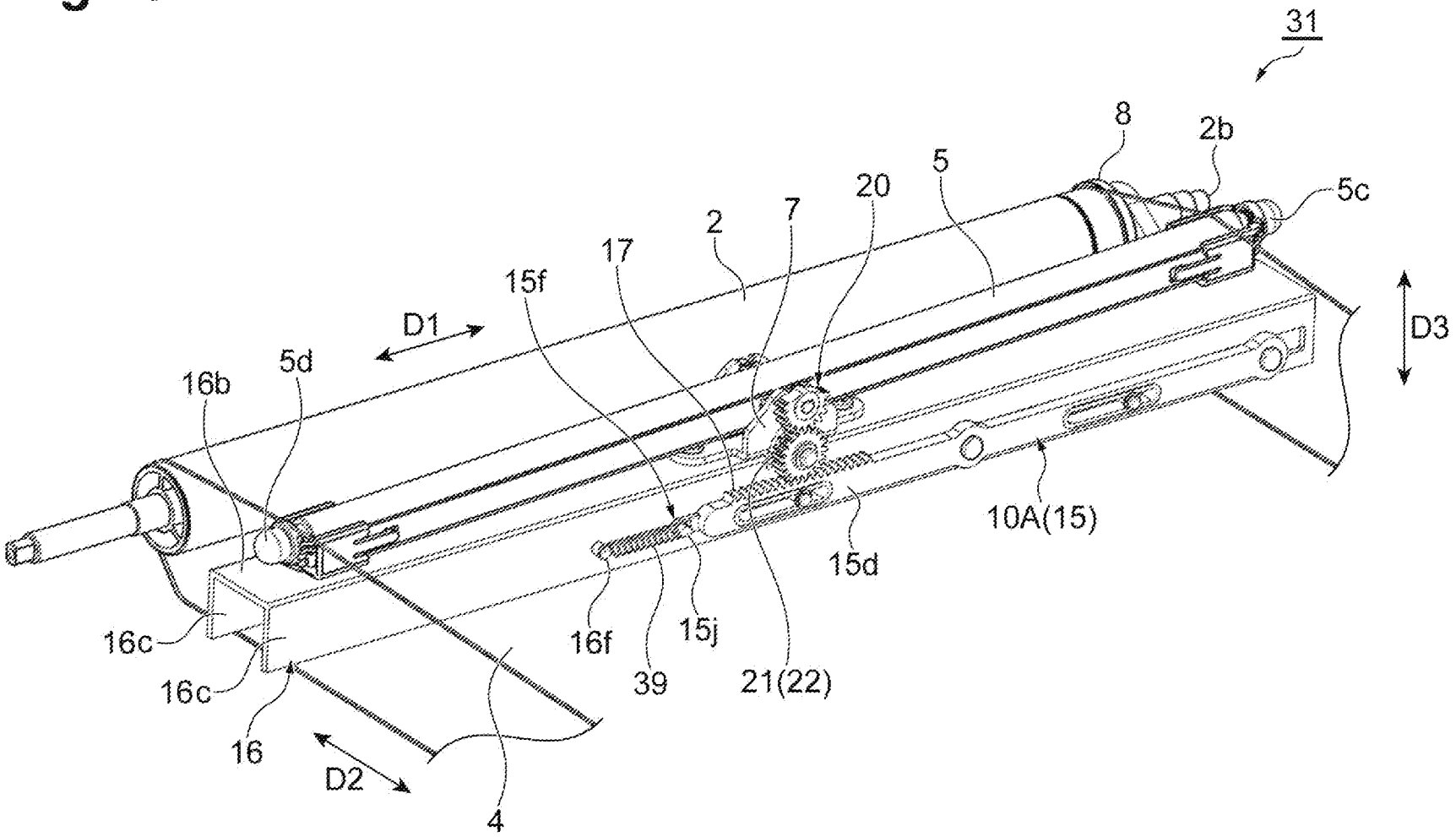
FIG. 13 is a perspective view of components of an example belt driving device, including a link mechanism, a tilting mechanism, and a steering member.
Figure 14:
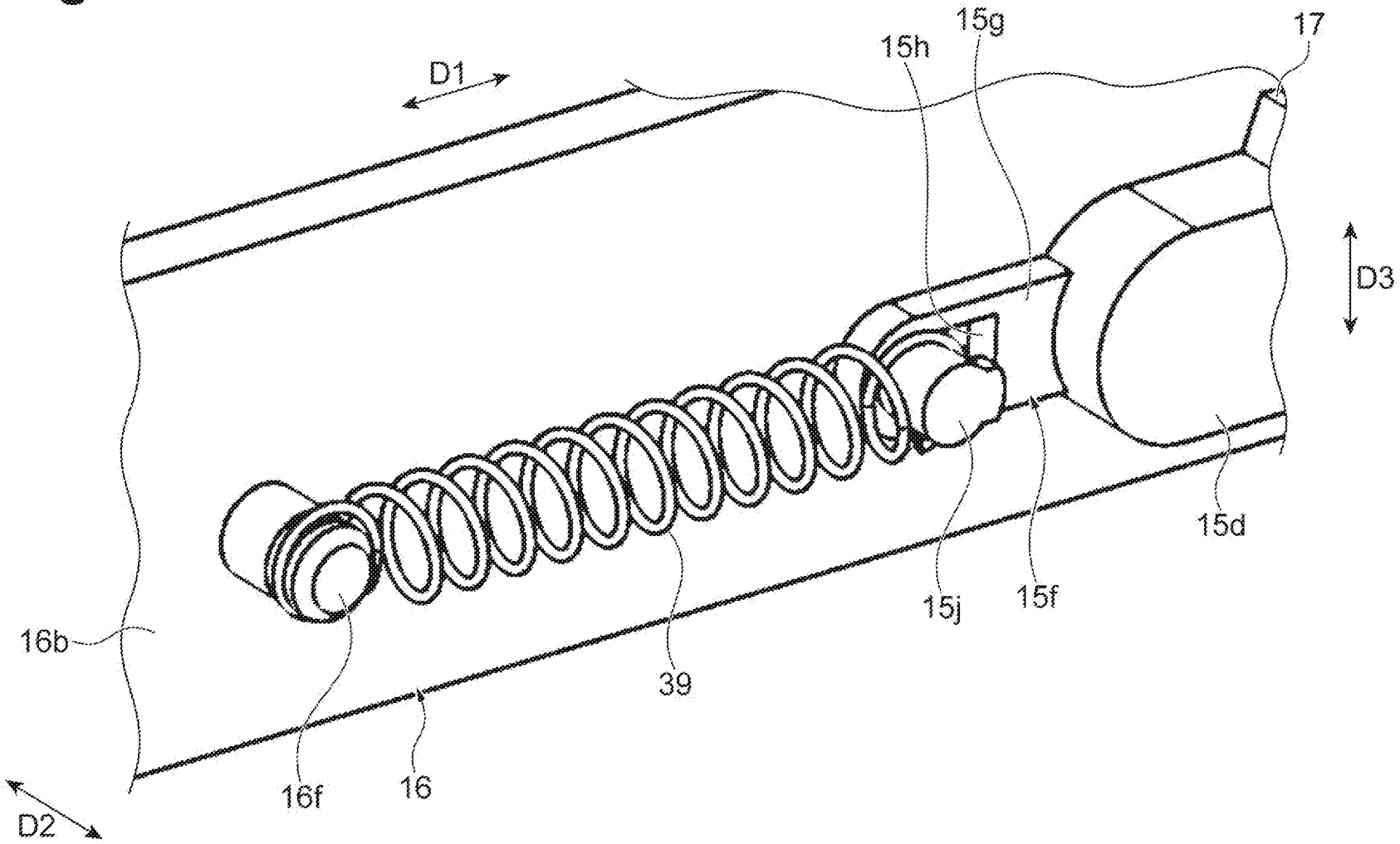
FIG. 14 is a perspective view of a spring of the example link mechanism illustrated in FIG. 13.

With reference to FIGS. 13 and 14, an example belt driving device 31 includes a spring 39 which is provided inside the endless belt 4 instead of the spring 9. In some examples, in the belt driving device 31, the guide member 16 includes a protrusion 16*f* which protrudes from one second plate portion 16*c* toward the opposite side of the first belt roller 2 and the protrusion 16*f* is provided at the distal end of a front end portion 15*f* of the second member 15.

The front end portion 15*f* may be provided between the protrusion 16*f* and the tilting mechanism 20. In some examples, the front end portion 15*f* includes a plate-shaped portion 15*g*, a concave portion 15*h*, and a protrusion 15*j*, The plate-shaped portion 15*g* protrudes from the second bar-shaped portion 15*d* toward the opposite side of the tilting mechanism 20 and extends in both of the direction D1 and the direction D3. The concave portion 15*h* is recessed in the plate-shaped portion 15*g* in the direction D2. The protrusion 15*j* protrudes from a bottom surface of the concave portion 15*h* toward the opposite side of the first belt roller 2. In some examples, a first end of the spring 39 is supported by the protrusion 15*j* of the second member 15 and a second end of the spring 39 is supported by the protrusion 16*f* of the guide member 16. In some examples, the spring 39 is a tensile coil spring which urges the second member 15 in a pulling direction.

In some examples, the belt driving device 31 may include the spring 39 which urges the second member 15 of the slide member 10A toward the opposite side of the tilting mechanism 20, in order to return the tilting motion of the steering member 5 to an original state by the spring 39 and to stabilize the tilting motion of the steering member 5. The spring 39 provided inside the endless belt 4 prevents foreign substances such as toner or paper dust from intruding into the spring 39, thereby preventing a state in which the urging of the spring 39 is disturbed by foreign substances, which in turn increases the life of the spring 39.

Figure 15:
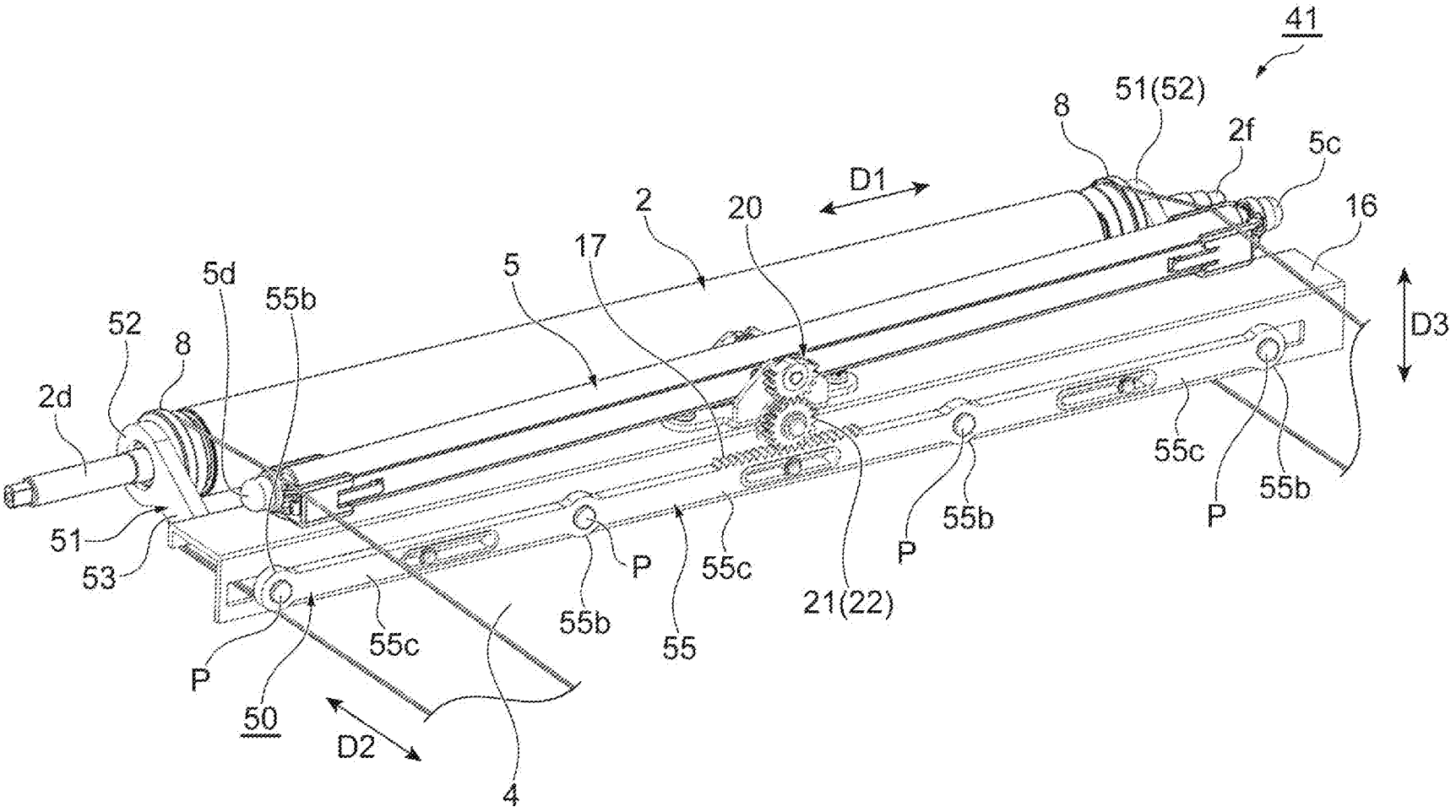
FIG. 15 is a perspective view of components of an example belt driving device, including a link mechanism, a tilting mechanism, a first belt roller, and a steering member according to another modified example.
Figure 16:
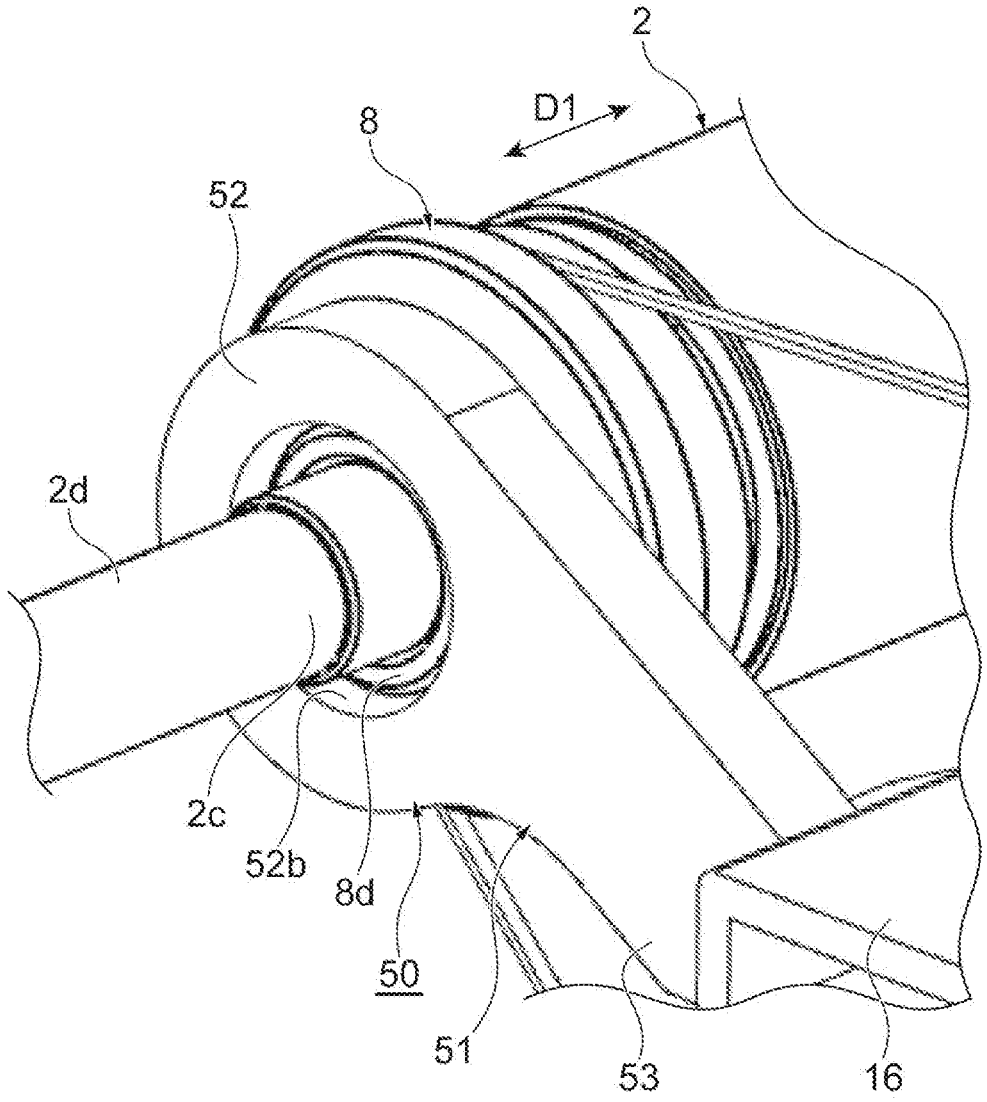
FIG. 16 is a partial perspective view illustrating an end of the example first belt roller illustrated in FIG. 15.
Figure 17:
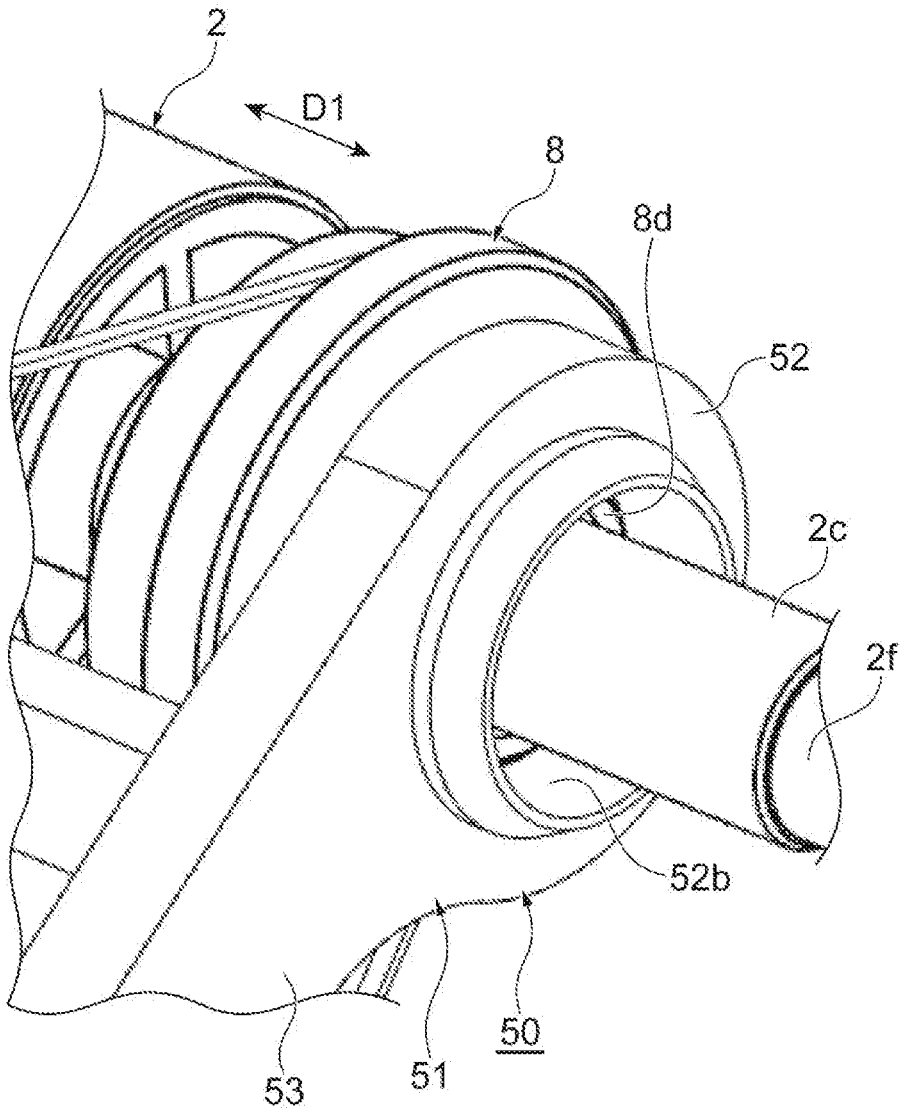
FIG. 17 is a partial perspective view illustrating an end portion of the example first belt roller illustrated in FIG. 15.

FIG. 15 is a perspective view illustrating an example belt driving device 41. FIG. 16 is an enlarged perspective view illustrating a first end 2*d* of an example first belt roller 2 of the belt driving device 41. FIG. 17 is an enlarged perspective view illustrating a second end 2*f* opposite to the first end 2*d* of the first belt roller 2 of the belt driving device 41. The belt driving device 41 includes a pulley 8 at both ends in the direction D1. The belt driving device 41 does not include the springs 9 and 39.

With reference to FIGS. 15 to 17, the example belt driving device 41 includes a link mechanism 50. The link mechanism 50 includes a pair of arm portions 51 which extend from the first end 2*d* and from the second end 2*f*, respectively, of the first belt roller 2 in a direction intersecting the direction D1, and a slide portion 55 which connects the pair of arm portions 51. Each arm portion 51 may be plate-shaped, and have a constant thickness in the direction D1 when viewed from each pulley 8.

The example arm portion 51 includes a connection portion 52 which is connected to the first belt roller 2 and an extension portion 53 which extends from the connection portion 52 toward the lower side of the steering member 5. In some examples, the connection portion 52 extends from the extension portion 53 into a circular shape. The connection portion 52 may be provided with a through-hole 52*b* in the direction D1, to insert the small diameter portion 8*d* of the pulley 8 and the shaft portion 2*c* of the first belt roller 2, in the direction D1. An end portion opposite to the first belt roller 2 of each arm portion 51 may be connected to the slide portion 55 by the pin P. In some examples, opposite ends of the slide portion 55 are exposed beyond the endless belt 4 and the rest of the slide portion 55 is located within the endless belt 4. The slide portion 55 may be bar shaped and extend in the direction D1, from the second end 2*f* to the first end 2*d* of the first belt roller 2. Accordingly, the slide portion 55 extends similarly to the second member 15.

The example slide portion 55 includes a plurality of insertion portions 55*b* through which the pin P is inserted and a plurality of bar-shaped portions 55*c* located between two adjacent insertion portions 55*b*. In some examples, the width of each insertion portion 55*b* in the direction D3 is wider than the width of each bar-shaped portion 55*c* in the direction D3. In some examples, the slide portion 55 includes four insertion portions 55*b* which are arranged side by side in the direction D1 and three bar-shaped portions 55*c* which are arranged side by side in the direction D1. Among three bar-shaped portions 55*c*, an upper surface of the bar-shaped portion 55*c* located at the center of the direction D1 is provided with the rack portion 17.

As described above, the belt driving device 41 may include the link mechanism 50 including the pair of arm portions 51 and the slide portion 55, in which the upper surface of the bar-shaped portion 55*c* of the slide portion 55 is provided with the rack portion 17. Accordingly, the gear portion 21 of the tilting mechanism 20 rotates in accordance with the linear motion of the rack portion 17 in the direction D1 and the steering member 5 can be tilted by the rotation of the gear portion 21.

The link mechanism 50 may include the pair of arm portions 51, respectively attached to the second end 2*f* and to the first end 2*d* of the first belt roller 2 and extending in a direction intersecting the direction D1, and the slide portion 55 provided between the pair of arm portions 51 to extend in the direction D1. Since each end portion of the slide portion 55 in the direction D1 is connected to the first belt roller 2 through the arm portion 51, the springs 9 and 39 are not necessary, which simplifies the link mechanism 50.

When the endless belt 4 is displaced toward the first end 5*c* of the steering member 5, the second end 5*d* of the steering member 5 is actuated to move upward by the linear motion of the link mechanism 50 and the rotational motion of the tilting mechanism 20. Consequently, the endless belt 4 moves toward the second end 5*d*. When the endless belt 4 is displaced toward the second end 5*d* of the steering member 5, the first end 5*c* of the steering member 5 is actuated to move upward by the linear motion of the link mechanism 50 and the rotational motion of the tilting mechanism 20. Consequently, the endless belt 4 moves toward the first end 5*c*. Accordingly, both of displacements of the endless belt 4, toward the first end 5*c* and toward the second end 5*d*, may be corrected by the link mechanism 50 and the tilting mechanism 20.

Figure 18:
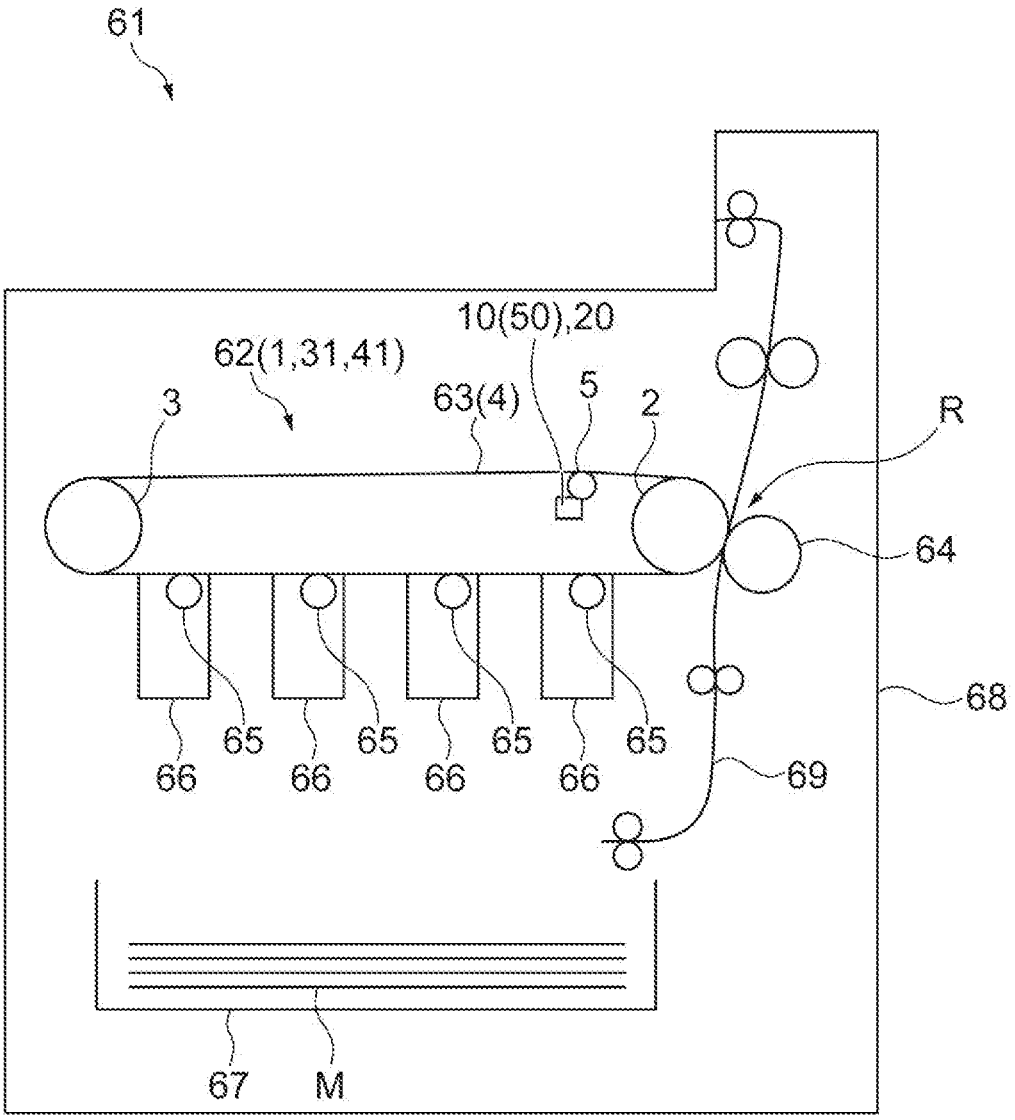
FIG. 18 is a schematic diagram of an example imaging system including an example intermediate transfer device.

With reference to FIG. 18, an example imaging system 61 may include an example belt driving device as described above, as an intermediate transfer device 62. The example imaging system may be a color image forming apparatus which includes the intermediate transfer device 62. For better ease of understanding, the entire imaging system 61 is not illustrated in FIG. 18. The intermediate transfer device 62 may include any one of the belt driving device 1, the belt driving device 31, and the belt driving device 41. The intermediate transfer device 62 includes the first belt roller 2, the second belt roller 3, an intermediate transfer belt 63 which is the endless belt 4, and a secondary transfer roller 64.

The example imaging system 61 may include process cartridges 66 which include respective photoconductors 65 arranged in the movement direction of the intermediate transfer belt 63, and a cassette 67 which accommodates a printing medium M of the imaging system 61, in addition to the intermediate transfer device 62. In some examples, the process cartridges 66 collectively include the photoconductor 65, a developing device, a charging device, and a cleaning device.

In some examples, the imaging system 61 may include a casing 68 onto which a plurality of process cartridges 66 are attached and each process cartridge 66 may be attachable to and detachable from the casing 68 in such a manner that a door of the casing 68 is opened and the process cartridge 66 is inserted into and extracted from the casing 68. In some examples, the cassette 67 is opened and closed to accommodate the printing medium M. The printing medium M accommodated in the cassette 67 may be picked up and conveyed by a medium conveying device 69. The medium conveying device 69 may allow the printing medium M to reach a secondary transfer region R at a timing in which the toner image transferred onto the intermediate transfer belt 63 of the intermediate transfer device 62 reaches the secondary transfer region R.

In some examples, as described above, the endless belt 4 (the intermediate transfer belt 63) is stretched over the first belt roller 2 and the second belt roller 3. The first belt roller 2, the second belt roller 3, the endless belt 4, the steering member 5, the tilting mechanism 20, and the link mechanisms 10 and 50 form part of the belt driving device 1, 31, and 41. The belt driving device 1, 31, and 41 correspond to the intermediate transfer device 62. The tilting mechanism 20 is provided inside the intermediate transfer belt 63 in the example imaging system 61, to prevent foreign substances such as toner or paper dust from intruding into the tilting mechanism 20, thereby increasing the life span of the tilting mechanism 20 and of the intermediate transfer belt 63 mounted on the imaging system 61.

It is to be understood that not all aspects, advantages and features described herein may necessarily be achieved by, or included in, any one particular example. Indeed, having described and illustrated various examples herein, it should be apparent that other examples may be modified in arrangement and detail.

For example, although an example in which the tilting mechanism 20 includes the gear portion 21 and the steering member 5 is tilted by the rack and pinion mechanism has been described, the tilting mechanism may be one that does not include a gear portion and that may tilt the steering member by a mechanism other than the rack and pinion mechanism. In some examples, the imaging system may tilt the steering member via a tilting mechanism which is a link mechanism instead of the gear portion. Accordingly, the configuration of the tilting mechanism may be modified. Further, the configuration of the link mechanism, the configuration of the steering member, the configuration of the belt driving device, or the configuration of the imaging system may also be modified.

The invention claimed is:

1. An imaging system comprising:

a belt roller extending in a longitudinal direction;

an endless belt to rotate about the belt roller;

a steering member located inside the endless belt;

a tilting mechanism operably coupled to a center portion of the steering member; and a link mechanism which is operably coupled to the tilting mechanism to pivot the steering member in response to a displacement of the endless belt in the longitudinal direction of the belt roller.

2. The imaging system according to claim 1, wherein the link mechanism includes a slide member to move in the longitudinal direction of the belt roller in response to a shifting of the endless belt, the slide member to actuate the tilting mechanism to tilt the steering member, when the slide member moves in the longitudinal direction.

3. The imaging system according to claim 2, wherein the tilting mechanism includes a gear portion operably coupled between the steering member and slide member of the link mechanism, to convert a linear movement of the slide member in the longitudinal direction into a pivotal movement of the steering member.

4. The imaging system according to claim 3, wherein the slide member includes a rack portion extending in the longitudinal direction, wherein the gear portion includes a rotatable pinion portion mounted on a rotation shaft located adjacent a center portion of the steering member, the pinion portion to engage with the rack portion, and wherein the tilting mechanism to tilt the steering member when the pinion portion rotates.

5. The imaging system according to claim 4, wherein the pinion portion includes a first gear to rotate, wherein the gear portion includes a second gear rotatably coupled to the first gear, and wherein the second gear is rigidly fixed to a center portion of the steering member to tilt the steering member in response to a rotation of the first gear.

6. The imaging system according to claim 3, wherein the gear portion is located inside the endless belt.

7. The imaging system according to claim 3, comprising a mounting shaft, wherein the gear portion includes a gear removably mounted on the mounting shaft, the mounting shaft to accommodate gears of different sizes.

8. The imaging system according to claim 2, wherein the slide member includes a first member that is attached to an end of the belt roller and a second member that is connected to the tilting mechanism.

9. The imaging system according to claim 8, wherein the first member extends from the end of the belt roller in a direction intersecting the longitudinal direction of the belt roller, and wherein the second member extends from the first member in the longitudinal direction.

10. The imaging system according to claim 8, wherein the first member has a first side extending in a direction intersecting the longitudinal direction from a first end adjacent the belt roller to a second end opposite the first end, a second side extending from the second end of the first side toward the tilting mechanism, and a third side extending from the second side opposite the first side, toward an end of the belt roller.

11. The imaging system according to claim 10, wherein the first side, the second side, and the third side form a right triangle.

12. The imaging system according to claim 8, comprising:

a spring which urges the second member of the slide member toward a side opposite to the tilting mechanism.

13. The imaging system according to claim 2, comprising:

a spring which urges an end of the belt roller via the slide member.

14. The imaging system according to claim 1, wherein the link mechanism includes a pair of arm portions attached to respective ends of the belt roller and extending in a direction intersecting the longitudinal direction, and a slide portion extending in the longitudinal direction between the pair of arm portions.

15. The imaging system according to claim 1, wherein the belt roller includes a first belt roller, wherein the imaging system includes a second belt roller extending in the longitudinal direction, wherein the endless belt is stretched over the first belt roller and the second belt roller, wherein the first belt roller, the second belt roller, the endless belt, the steering member, the tilting mechanism, and the link mechanism form a belt driving device, and wherein the belt driving device is an intermediate transfer device to sequentially transfer toner images carried on respective photoconductors.

* * * * *